United States Patent [19]

Myhre

[11] 4,453,642

[45] Jun. 12, 1984

[54] CARRIAGE-MOUNTED SKIDDING LINE TAKE-UP APPARATUS

[75] Inventor: Curth Myhre, Eugene, Oreg.

[73] Assignee: Danebo Parts and Equipment Inc., Eugene, Oreg.

[21] Appl. No.: 240,810

[22] Filed: Mar. 5, 1981

[51] Int. Cl.[3] ..... B66C 21/00

[52] U.S. Cl. ..... 212/78; 212/87; 212/89; 212/122

[58] Field of Search ..... 212/83–89, 212/270, 118, 122, 98, 77, 78, 71, 76, 94–97; 104/115, 116

[56] References Cited

U.S. PATENT DOCUMENTS

| | | | |
|---|---|---|---|
| 798,635 | 9/1905 | Stevenson . | |
| 1,015,103 | 1/1912 | Viering | 212/77 |
| 1,218,711 | 3/1917 | Sproul . | |
| 1,343,434 | 6/1920 | Cook . | |
| 1,445,116 | 2/1923 | Venable . | |
| 1,789,472 | 1/1931 | Meany | 212/89 |
| 2,403,095 | 7/1946 | Lear . | |
| 2,649,209 | 8/1953 | Wilson . | |
| 3,083,839 | 4/1963 | McIntyre | 212/87 |
| 3,094,222 | 6/1963 | McAllister . | |
| 3,105,597 | 10/1963 | Knott . | |
| 3,311,243 | 3/1967 | Bachmann . | |
| 3,322,397 | 5/1967 | Pillman . | |
| 3,531,000 | 9/1970 | Rennie et al. | 212/77 |
| 3,718,262 | 2/1973 | Lysons | 212/122 |
| 3,776,390 | 12/1973 | Junes et al. . | |
| 3,948,398 | 4/1976 | Christensen . | |
| 4,127,197 | 11/1978 | Dumont . | |
| 4,262,811 | 4/1981 | Montague | 212/122 |
| 4,329,926 | 5/1982 | Sowder et al. | 104/115 |
| 4,347,938 | 9/1982 | Gorsh | 212/121 |

*Primary Examiner*—Trygve M. Blix
*Assistant Examiner*—Stephen P. Avila
*Attorney, Agent, or Firm*—Kolisch, Hartwell, Dickinson & Anderson

[57] ABSTRACT

Apparatus for use in a skyline logging system. A carriage mounted for reversible travel on a skyline is transported by a skidding line connected to a hoisting line which feeds through the carriage for attachment to logs. A tagline is attached at one end to the skidding line and its other end is received by a take-up reel mounted on the carriage which is disengageably drivingly connected to a radio-controlled unidirectionally operable power-operated drive motor mounted on the carriage. When operated in an engaged mode, the reel takes up the tagline and hence the skidding line. The reel is allowed to pay out the tagline in a disengaged mode. Additionally, the motor is connected to a pinch-roll device, also mounted on the carriage, for pulling the hoisting line into and through the carriage in cooperation with the take-up reel.

1 Claim, 2 Drawing Figures

CARRIAGE-MOUNTED SKIDDING LINE TAKE-UP APPARATUS

BACKGROUND AND SUMMARY

This invention pertains generally to skyline logging systems and specifically, to such systems incorporating a skidding line, carriage and hoisting line.

In a conventional gravity skyline yarding system, the skyline is suspended between a mast or spar pole located adjacent a log-landing area and a tailhold which is typically a tree stump located down a slope from the landing area. Tension in the skyline is provided by a yarder, located at the landing. A carriage is mounted for reversible travel on the skyline. Transportation down the skyline is provided by gravity while transport up is provided by a skidding line also connected to a powered winch drum on the yarder. The skidding line passes from the yarder over a sheave or pulley mounted on the mast. From there it extends and is attached to a hoisting line. This latter line extends through the carriage over a swivel fairlead down toward the ground. The hanging end is fitted with a loop or clip for receiving choker cables used for hauling logs from the slope.

The carriage typically has a radio-controlled clamp on both the skyline and the hoisting line. During initiation of a logging operation in which the yearder is higher on a slope than the tailhold, the carriage is placed on the skyline near the yarder with both line clamps closed. The skyline clamp is released, allowing the yarder gradually to let the carriage slide down the skyline by paying out the skidding line. When the carriage reaches the desired location it is stopped by braking of the skidding line drum, the skyline clamp is closed and the hoisting line clamp is opened. By continuing to payout the skidding line from the drum and by inhauling the winch line in the carriage, the hoisting line is allowed to feed through the carriage as the suspended end drops to the ground under the pull of gravity. This letting out of the hoisting line is not practical because the skidding line tends to sag between the mast and carriage. This sagging causes the skidding line to defeat the pull of gravity caused by the suspended end of the hoisting line. However, by proper feeding by the yarder and inhauling the winch line in the carriage, the gravitational forces acting on the hoisting line win out.

The hoisting line is then secured to a log which has been cut and readied for removal from the forest. The yarder then reels in the skidding line which in turn causes the hoisting line, moving through the carriage, to lift the log toward the carriage. When the log achieves a desired height above the ground, the hoisting line clamp is closed and the skyline clamp is opened. By continued reeling in of the skidding line, the carriage and the accompanying suspended log are pulled to the yarding area. At this point the skyline clamp is closed and the hoisting line clamp released. By paying out the skidding line and inhauling the winch line in the carriage, the load is lowered to the ground.

Although this description has referred specifically to a gravity system, it will be appreciated that it can be used in other applications as well.

Various systems exist which provide means for hoisting logs to a carriage. One type uses a separate cable which is driven by the yarder to pull the logs up. Another type uses a carriage-mounted engine to haul the line onto a carriage-mounted drum or reel. None of these, however, assist gravitational forces in feeding out a hoisting line from the carriage.

It is, therefore, a general object of the invention to provide a skyline logging system which exhibits increased operational speed.

It is more specifically an object to provide in a carriage power-driven means for assisting gravitational forces in lowering a hoisting line attached to a skidding line.

These and additional objects and advantages of the present invention will be more clearly understood from a consideration of the drawings and the following detailed description of a preferred embodiment of the invention.

DETAILED DESCRIPTION OF THE INVENTION

Figures 1, 2:
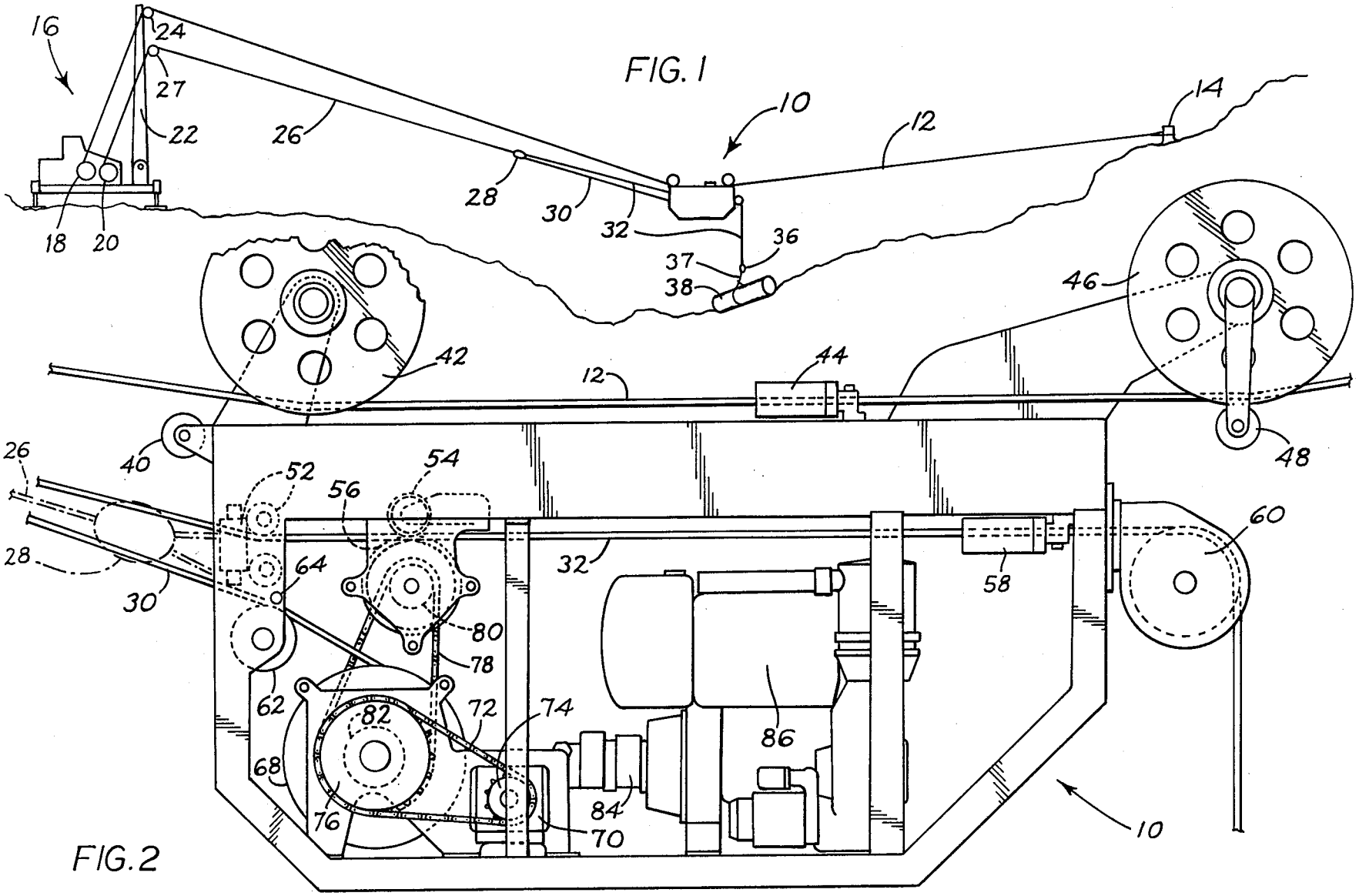
FIG. 1 is a schematic elevation of a gravity skyline yarding system made in accordance with the invention.
FIG. 2 is an enlarged side view of the carriage shown in the system of FIG. 1, with one side wall of the carriage housing removed to reveal internal details.

Referring now to FIG. 1, a carriage constructed in accordance with this invention is shown generally at 10 suspended from a skyline 12 which spans a sloping terrain having timber to be logged. The skyline is anchored on the right in FIG. 1 on a stump 14 commonly referred to as a tailhold. Tension in the skyline is provided by a yarder shown generally at 16 having power-driven drums, or reels, 18, 20 which are used to payout and take in cable attached thereto. Yarder 16 also has a mast, or spar pole, 22 to which is mounted a skyline sheave 24. Skyline 12 extends over sheave 24 to drum 18. A skidding line 26 extends from drum 20 over a skidding line sheave 27, also mounted on mast 22, to a three-way line shackle 28. A tagline 30 extends from shackle 28 into carriage 10. A hoisting line 32 extends from shackle 28 through carriage 10 and out the right side as shown in FIG. 1. It hangs under the force of gravity from carriage 10. The hanging end of hoisting line 32 has a clip 36 attached to a choker 37 wrapped around a log 38 which is ready for transport to a landing adjacent yarder 16.

Referring now specifically to the details of carriage 10 as shown in FIG. 2, skyline 12 extends from the left of the figure past a line guide 40, to a skyline sheave 42, through a radio-controlled skyline clamp 44, between a second skyline sheave 46 and an associated line guide 48, and away from carriage 10.

Hoisting line 32 extends past fairlead rollers 52 into a nip region formed between a pressure sheave 54 and a hoisting-line drive sheave 56. Sheaves 54 and 56 cooperate to form what is also referred to as pinch-roll means. From there it extends through a radio-controlled hoisting-line clamp 58 and over a pulley assembly commonly referred to as a swivel fairlead 60. From there it drops by the pull of gravity or a load toward the ground. The combination of skidding line 26 and hoisting line 32 constitutes herein line means.

Tagline 30, also referred to as a take-up line, enters carriage 10 from the left in FIG. 2 between a lead sheave 62 and a guide 64. It then extends to a tagline drum 68, also referred to as tagline take-up means. A hydraulic motor 70 is drivingly coupled to drum 68 by a chain 72 trained over a motor sprocket 74 and drum sprocket 76. Additionally, drive sheave 56 is drivingly connected to drum 68 through a chain 78 which is trained over a sprocket hidden by sprocket 76, and over a sprocket 80. A radio-controlled clutch 82 is also associated with the drive system just discussed for disengaging drum 68 to allow payout of tagline 30.

An oil pump 84, powered by an engine 86, pumps oil into an accumulator for operation of the skyline and hoisting line clamps, as well as for driving motor 70. The drive arrangement just discussed relating to sheave 56, drum 68, motor 70, pump 84 and engine 86 combine to form what is also referred to herein as a drive means. This same drive means, in cooperation with drum 68, is also referred to as take-up drive means. This, in cooperation with the take-up line, is also referred to as pull means.

Explaining the operation of carriage 10 in view of the operating environment explained previously, hoisting-line clamp 58 is closed and skyline clamp 44 is open when carriage 10 is lowered along skyline 12 into position in the vicinity of log 38, as shown in FIG. 1. Clamp 44 is then closed to hold carriage 10 in this position. Clamp 58 is opened to allow for feed through of hoisting line 32. By means of radio control, clutch 82 and motor 70 are engaged to provide powered take-up of tagline 30 on drum 68, and to pull concurrently hoisting line 32 into carriage 10 by means of the drive force supplied by drive sheave 56 in association with pressure sheave 54. Lines 30, 32 are therefore pulled to the right in FIG. 2 causing a corresponding pull on skidding line 26 when it is paid out from drum 20 in yarder 16. This results in a much speedier feed out of hoisting line 32 than would be possible without it. In dash-dot outline in FIG. 2, the skidding line and the tag line are shown in fully taken-up conditions.

Motor 70 is stopped while the hoisting line is being attached to the choker. Clutch 82 is then disengaged to allow payout of the tagline as skidding line 26 is wheeled in on drum 20. This also causes hoisting line 32 to pass through carriage 10 from the right to the left in FIG. 2, thereby raising log 38 from the ground. After the log has reached a desired height above the ground, hoisting-line clamp 58 is engaged and skyline clamp 44 is released. As skidding line 26 is taken up on drum 20, carriage 10 and its associated load move toward yarder 16.

Although the present embodiment has been shown for use in a gravity skyline logging system in which yarder 16 is generally above tailhold 14, it can be appreciated that the reverse arrangement is possible. It will also be appreciated that this invention would also find particular advantage in an essentially level skyline logging system, in which case the skidding line slack take-up feature would be critical to the lowering of the load-receiving end of a hoisting line.

It will thus be understood by those skilled in the art that other changes in form and detail may be made in the foregoing-described preferred embodiment without departing from the spirit and scope of the invention as defined in the following claims.

It is claimed and desired to secure by Letters Patent:

1. In a logging system having a skyline, a carriage mounted for reversible travel along the skyline, a skidding line, and a hoisting line extending along the carriage with one end attached to an end of the skidding line and another end constructed for receiving a load, skidding-line-pick-up apparatus comprising a tagline attached at one end to the skidding line adjacent the point where the skidding line attaches to the hoisting line, tagline take-up means mounted on the carriage operatively connected to said tagline for taking up and paying out the same from its other end, selectively actuatable, unidirectionally operable, power-operated drive means mounted on the carriage and disengageably drivingly connected to said take-up means, operable in an engaged mode to drive said take-up means in a manner causing the latter to take up said tagline, and hence the skidding line, and in a disengaged mode to free said take-up means so as to allow the same to pay out said tagline and hence the skidding line, and power-operated pinch-roll means operatively receiving the hoisting line where the same extends along the carriage, and drivingly connected to said drive means for operation in coordination with said take-up means to pull the hoisting line into and through the carriage, wherein the driving connection between said pinch-roll means and said drive means is through said take-up means.

* * * * *